United States Patent [19]

Felgentreu

[11] Patent Number: 5,067,839

[45] Date of Patent: Nov. 26, 1991

[54] STYLO PEN TIP AND AUXILIARY REMOVING TOOL

[75] Inventor: Peter Felgentreu, Hamburg, Fed. Rep. of Germany

[73] Assignee: Koh-I-Noor Inc., Hamburg, Fed. Rep. of Germany

[21] Appl. No.: 625,016

[22] Filed: Dec. 10, 1990

[30] Foreign Application Priority Data

Dec. 12, 1989 [DE] Fed. Rep. of Germany ..... 3940968

[51] Int. Cl.[5] ..... B43K 8/16; B43K 9/00; B43K 13/00

[52] U.S. Cl. ..... 401/258; 401/134; 401/195; 401/251

[58] Field of Search ..... 401/132, 133, 134, 135, 401/251, 258, 259, 260, 195

[56] References Cited

U.S. PATENT DOCUMENTS

| | | | |
|---|---|---|---|
| 1,712,141 | 5/1929 | Folk | 401/134 |
| 3,830,574 | 8/1974 | Glombitza et al. . | |
| 4,341,481 | 7/1982 | Wollensak | 401/251 |
| 4,493,575 | 1/1985 | Mutschler | 401/195 |
| 4,595,308 | 6/1986 | Schiefnetter | 401/25 X |
| 4,930,921 | 6/1990 | Anderka | 401/258 |

FOREIGN PATENT DOCUMENTS

| | | | |
|---|---|---|---|
| 2538427 | 3/1977 | Fed. Rep. of Germany | 401/135 |
| 3009169 | 10/1981 | Fed. Rep. of Germany . | |
| 8136741 | 4/1982 | Fed. Rep. of Germany . | |
| 3400522 | 7/1985 | Fed. Rep. of Germany | 401/259 |
| 86673 | 1/1952 | France | 401/133 |
| 1048243 | 12/1953 | France . | |
| 22806 | 11/1958 | German Democratic Rep. | 401/259 |
| 7904617 | 6/1979 | Netherlands | 401/258 |
| 273514 | 7/1927 | United Kingdom | 401/251 |

*Primary Examiner*—Steven A. Bratlie

*Attorney, Agent, or Firm*—Fitzpatrick, Cella, Harper & Scinto

[57] ABSTRACT

A stylo pen tip has a front part (2) supporting the writing tube (6), on which a writing fluid cartridge (10) has been placed from behind with its front section. The front end area of the writing fluid cartridge (10) forms a narrowed, elastically stretchable opening cross section (12) which, in the operating position, grasps a protrusion area (8) formed on the front part (2) from behind. An auxiliary tool (19, 20) can be placed from the front on the front part (2) and can be brought into stretching engagement with the stretchable opening cross secion (12) of the writing fluid cartridge (10) in order to allow a separation of the front part (2) and the writing fluid cartridge (10) from each other.

6 Claims, 2 Drawing Sheets

STYLO PEN TIP AND AUXILIARY REMOVING TOOL

BACKGROUND OF THE INVENTION

1. Field of the Invention

The invention relates to a stylo pen tip with a front part supporting a writing tube, wherein the front section of a writing fluid cartridge is mounted from behind. The writing fluid cartridge has a closure element which is to be released by the front part when the front part is inserted into an operating position, within the writing fluid cartridge. An area of the cartridge front end has a reduced, elastically stretchable opening cross section which, in the operating position, grips behind a protrusion area that is formed on the front part. The outer diameter of the front part, in the area ahead of the protrusion area, is less in the operating position of the front part than the maximum diameter of the opening cross section.

2. Brief Description of the Prior Art:

In a known stylo pen tip, (German Letters Patent 37 09 918) a stretchable opening cross section of the writing fluid cartridge is, when in the operating position, in a practically unreleasable contact, with the front part. In other words, the stretchable opening cross section grips the protrusion area of the front part from behind, so that the user no longer can separate the two elements. It is intended thereby, to prevent the user from producing an unsuitable combination of writing fluid cartridge and front part. For example, the front part may be designed in such a way that it normally will not function, or remain sufficiently clear, after the writing fluid in a writing fluid cartridge has been used up.

A stylo pen tip is known (French Letters Patent 1 048 243), where an enlargement, in the form of either an approximately lens-shaped head or an annular rib, has been provided at the rear of the front part. This enlargement comes into engagement with a correspondingly formed annular end area of the writing fluid cartridge when the end of the front part is pushed into the front of the writing fluid cartridge. In this manner, a ball-shaped closure is displaced into the interior chamber of the writing fluid cartridge and is held secure, against being pulled out. The insertion movement is limited by the contact of a front part projection with the writing fluid cartridge that radially extends beyond the front edge of the writing fluid cartridge. Due to this shape of the protruding area on the front part and the elasticity to the material of the writing fluid cartridge, the user can separate the two parts by hand. However, there is a danger that such a separation will take place unintentionally. Even if a separation is performed on purpose, it is possible that during separation there will be a sudden displacement of the two parts, causing remaining writing fluid to be spilled.

OBJECT AND SUMMARY OF THE INVENTION

It is object of the invention to improve a stylo pen tip in such a way that the front part and the writing fluid cartridge can be separated in a controlled manner, whereby after writing fluid in a writing fluid cartridge has been used up, a new writing cartridge can be placed on the front part.

To attain this object, a stylo pen tip of the type mentioned above is designed, in accordance with the invention, so that an auxiliary tool is placed from the front on the front part, and brought into stretching contact with a stretchable opening cross section of a writing fluid cartridge.

Thus, an auxiliary tool is placed from the front onto the front part of the stylo pen, in accordance with the invention, so that the opening cross section of the writing fluid cartridge can be stretched in a controller manner. The stretched opening cross section then may traverse the protrusion area of the front part either by direct action of the auxiliary tool, or by a slight backward displacement movement carried out by the user. In this way, the separation movement is performed smoothly and not jerkily, and there is no danger of spilling remaining writing fluid.

To make the stretchable opening cross section both sufficiently strong for grasping the protrusion area from behind, and sufficiently elastic for stretching, slits that open towards the front and extend parallel to the cartridge axis may be provided in the area of the stretchable cross section.

An outer thread, for a screw engagement with the auxiliary tool, may be disposed in the section of the front part located ahead of the protrusion area and also may be partially covered by the stretchable cross section. Hence, as the auxiliary tool is screwed on it can both generate sufficient force for widening the opening cross section and be brought into contact with the cartridge in an easily controllable manner.

The back of the protrusion area may form a stop for the contact of a surface area of the writing cartridge so as to prevent further forward displacement of the writing fluid cartridge on the front part.

The writing fluid cartridge may be composed of several parts. It may have an inner cartridge part forming the writing fluid reservoir, and it may have a groove for forming a pressure equalization chamber on the inside of its front area.

The auxiliary tool may represent a separate component. However, it also may be formed, for example, at the back of a protective cap which can be placed on the writing fluid cartridge from the front.

In summary, there is provided a stylo pen tip of the type where a front part supports a writing tube, and the front part has a rear section which extends into a front section of a writing fluid cartridge. The writing fluid cartridge also has a closure element which is to be released by the front part when the front part is inserted into an operating position in the writing fluid cartridge. The front section of the writing fluid cartridge has a narrowed, elastically stretchable opening cross section which, in the operating position, grips the front of a protrusion area formed on the front part. The front part, in the operating position, also has an area located ahead of the protrusion area with an outer diameter that is smaller than the maximum inside diameter of the opening cross section. Hence, as the auxiliary tool is engaged with the front part and is brought into a stretching contact with the stretchable opening cross section of the writing fluid cartridge, the cartridge can be easily removed.

The invention will be described further hereafter, by reference to the drawings, which illustrate an exemplary embodiment.

DETAILED DESCRIPTION OF THE PREFERRED EMBODIMENT

Figure 1:
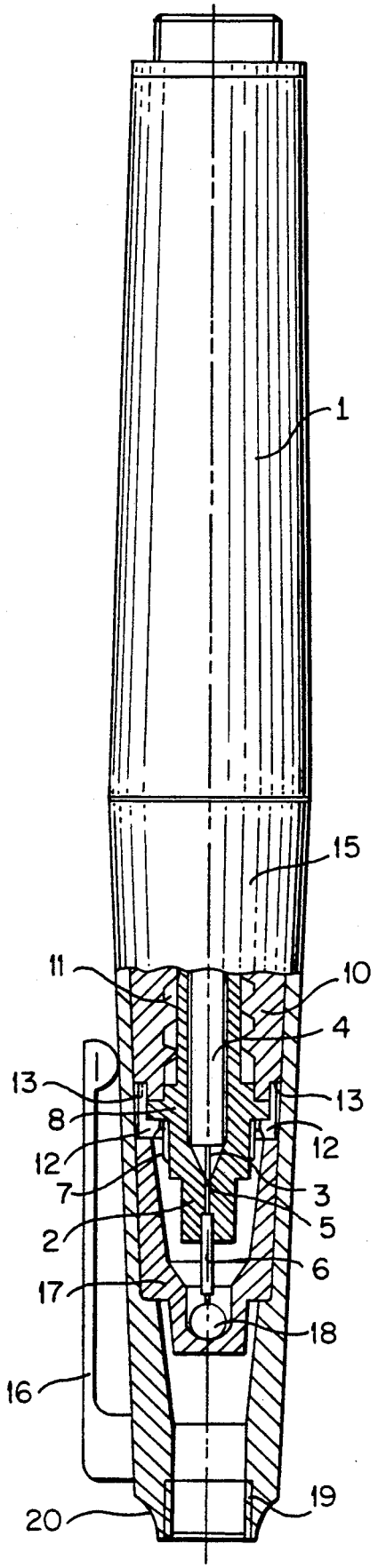
FIG. 1 is a plan view of stylo pen, partially in section.
Figure 2:
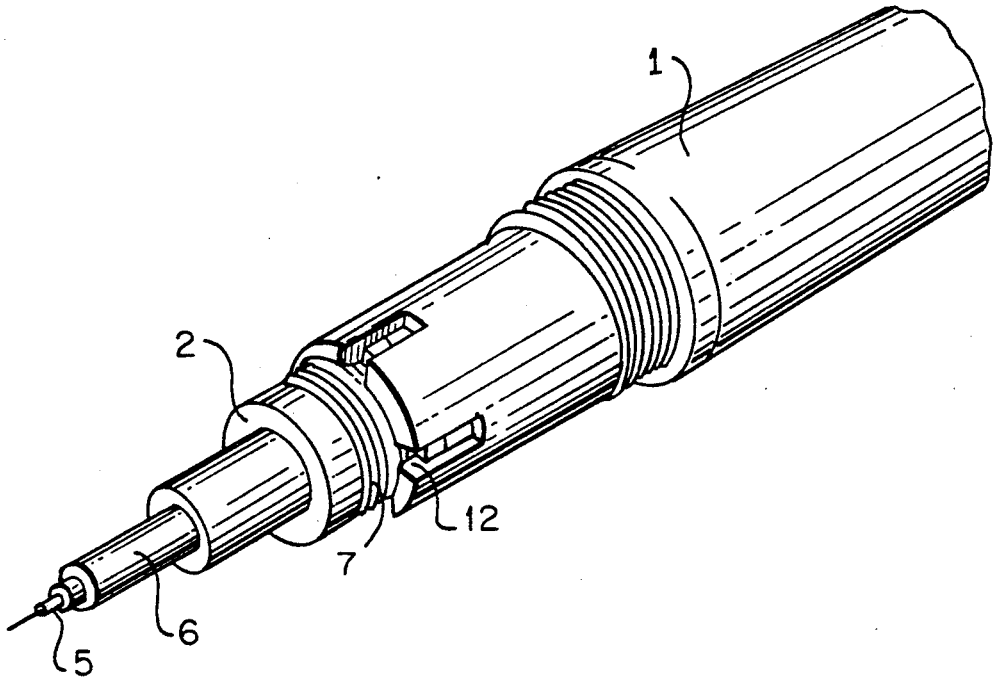
FIG. 2 is a perspective view of the front part the stylo pen shown in FIG. 1.

The illustrated stylo pen may have a structure in the area of the holder shaft 1 and the protective cap 15, (not shown in section), which essentially corresponds to that of the a stylo pen in accordance with FIGS. 2 and 3 of German Patent, DE 09 918 (C1). However, in the operational state, the front part 2 is not in a barb-like engagement with an area of the writing fluid cartridge adjacent to the closure element, when in a sealing position.

In the illustrated stylo pen, a weight body 4 axially is movable back and forth in a limited manner, within inner bore 3 of the front part 2. A cleaning wire 5 is fixed in the front part, and extends in a customary way into the writing tube 6, which fixed on the front of front part, 2. The rear section of the front part 2 sealingly extends into the front area of the writing fluid cartridge 10, so that a pressure equalization chamber is formed therebetween by a spiral-like channel 11 provided in the inner wall of the writing fluid cartridge 10. The equalization chamber is in a conventional, (not illustrated), communications with the writing fluid reservoir of the writing fluid cartridge 10. The reservoir also is connected with the back of the front part 2, and thus with the back of the inner bore 3, by means of the insertion of the front part 2 into the writing fluid cartridge 10 up to the depth shown, and the release of a closure part, (not shown).

Hook-shaped protrusions 12 are formed on the front end of the writing fluid cartridge 10 by means of axial cuts (FIG. 2), so that hook sections protrude radially inwardly and can be radially and elastically displaced toward the outside. Thus, when the front part 2 is inserted into the writing fluid cartridge 10 from the front, the annular shoulder 8 of the front part 2 comes into contact with front areas of the hook-shaped protrusions 12, which extend radially inward in a slightly oblique way, and elastically spreads them open. The annular shoulder 8 then passes through the hook sections, until there is a contact between a front end surface 13 of the writing fluid cartridge 10 and a rear annular surface of the front part. In this position, the hook-shaped protrusions 12 will snap back elastically into the position as shown, and in this fashion the front part 2 is secure and cannot be axially displaced.

The section of the front part 2 following the annular shoulder 8, in the direction towards the front, has a smaller diameter than the inside diameter in the area of the hook sections of the protrusions 12. An outer thread 7 extends backwardly, as far as the annular shoulder 8.

A customary protective cap 15, which has a clip 16, has been placed from the front on the illustrated stylo pen. A sealing insert 17 of customary design has been placed inside the cap, and in the bottom area of an elastic sealing element 18 is fixed. This element sealingly closes the front end of the writing tube 6 when the protective cap 15 has been placed on it.

At the outer end of the protective cap 15, there is an opening in which an inner thread 19 has been cut, and the outer circumference of the rear end area has a wedge surface 20, which is radially curved outward, from the back to the front.

To separate the front part 2 from the writing fluid cartridge 10, for example, if the writing fluid cartridge 10 is empty, the protective cap 15 is screwed so its inner thread 19 moves upon the outer thread 7 of the front part 2, until an open area of the front part 2 located in front of the outer thread 7, including the writing tube 6, extends into an opening which extends beyond the inner thread 19 and into the protective cap 15. In the course of this movement, the wedge surface 20 reaches an area between outer thread 7 and a hook section of the protrusion 12. The wedge pushes the protrusions 12 elastically apart until the annular shoulder 8 is free from the hood-shaped sections of the protrusions 12 and the writing fluid cartridge 10 then can be pulled off backwards, from the front part 2.

While the present invention has been described with respect to what is presently considered to be a preferred embodiment, it is to be understood that the invention is not limited to the disclosed embodiment. The present invention is intended to cover various modifications and equivalent arrangements included within the spirit and scope of the appended claims.

I claim:

1. A stylo pen tip which comprises a front part (2) supporting a writing tube (6), (a) said front part (2) having a rear section that extends into a front section of a writing fluid catridge (10), (b) said writing fluid cartridge (10) having a closure element which is to be released by said front part (2) when said front part (2) is inserted into an operating position in said writing fluid cartridge (10), (c) said front section of said writing fluid cartridge (10) having an elastically stretchable opening cross section (12) on its front end which is narrowed with respect to the rest of the writing fluid cartridge and which, in the operating position, grips the front of a protrusion area (8) formed on said front part (2), (d) wherein said front part (2), in said operating position, has an open area located ahead of said protrusion area (8) that is defined by an outer diameter smaller than the maximum inside diameter of said opening cross section (12), (e) so that an auxiliary tool (19,20) can be engaged within the open area of said front part (2) and brought into a stretching contact with said stretchable opening cross section (12) of said writing fluid cartridge (10).

2. A stylo pen tip in accordance with claim 1, wherein axially extending slits which are toward the front are formed in said elastically stretchable opening cross section (12).

3. A stylo pen tip in accordance with claim 1, wherein an outer thread (7) for a screwing onto said auxiliary tool (19,20) is disposed in a section of said front part (2) that is located ahead of said protrusion area (8) and is partially covered by said elastically stretchable cross section (12).

4. A stylo pen tip in accordance with claim 1 wherein the back of said protrusion area (8) forms a stop for contacting a surface area (13) of said writing fluid cartridge (10) so as to prevent a further forward displacement of said writing fluid cartridge (10) onto said front part (2), beyond said operating position.

5. A stylo pen tip in accordance with claim 1 wherein said writing fluid cartridge (10) has an inner cartridge part forming a writing fluid reservoir, and a groove (11) for forming a pressure equalization chamber at the inside of said front section of said writing fluid cartridge (10).

6. A stylo pen tip in accordance with claim 1 wherein said auxiliary tool (19,20) is formed at a rear end of a protective cap (15) which can be engaged upon said writing fluid cartridge (10), from the front.

* * * * *